US009401072B2

(12) United States Patent
de Waal et al.

(10) Patent No.: US 9,401,072 B2
(45) Date of Patent: Jul. 26, 2016

(54) PLAYER REWARD PROGRAM WITH LOYALTY-BASED REALLOCATION

(75) Inventors: Daniel J. de Waal, Las Vegas, NV (US); Vincent P. Smith, Las Vegas, NV (US); Cameron Anthony Filipour, Las Vegas, NV (US); Ali M. Saffari, Reno, NV (US)

(73) Assignee: IGT, Las Vegas, NV (US)

( * ) Notice: Subject to any disclaimer, the term of this patent is extended or adjusted under 35 U.S.C. 154(b) by 1570 days.

(21) Appl. No.: 12/565,238

(22) Filed: Sep. 23, 2009

(65) Prior Publication Data

US 2011/0070944 A1 Mar. 24, 2011

(51) Int. Cl.
*A63F 9/24* (2006.01)
*G07F 17/32* (2006.01)

(52) U.S. Cl.
CPC ..... *G07F 17/3255* (2013.01); *G07F 17/32* (2013.01); *G07F 17/3239* (2013.01); *G07F 17/3244* (2013.01); *G07F 17/3267* (2013.01)

(58) Field of Classification Search
CPC . G06F 17/32; G06F 17/3244; G06F 17/3267; G06F 17/3251; G06F 17/3262; G06F 17/3239; G06F 17/3255
USPC ..... 463/25; 340/5.4, 5.41, 4.42; 725/4, 6; 726/6; 705/14.1; 902/23
See application file for complete search history.

(56) References Cited

U.S. PATENT DOCUMENTS 5,816,918 A 10/1998 Kelly et al.
6,110,042 A 8/2000 Walker et al.
6,193,608 B1 * 2/2001 Walker et al. ..... 463/25
6,227,972 B1 5/2001 Walker et al.
6,558,255 B2 * 5/2003 Walker et al. ..... 463/25
6,575,832 B1 6/2003 Manfredi et al.
6,848,995 B1 2/2005 Walker et al.
6,890,256 B2 5/2005 Walker et al.
7,048,628 B2 5/2006 Schneider
7,063,618 B2 6/2006 Walker et al.
7,086,947 B2 8/2006 Walker et al.
7,094,149 B2 8/2006 Walker et al.
7,267,614 B1 9/2007 Jorasch et al.
7,318,775 B2 1/2008 Brosnan et al.
7,458,892 B2 12/2008 Walker et al.
7,473,177 B2 1/2009 Walker et al.
7,549,920 B2 6/2009 Jorasch et al.
7,658,674 B2 2/2010 Walker et al.

(Continued)

OTHER PUBLICATIONS

PCT Foreign Search Report related to Application No. PCT/US2010/049930 dated Nov. 17, 2010.

(Continued)

*Primary Examiner* — Jason Yen
(74) *Attorney, Agent, or Firm* — Neal, Gerber & Eisenberg LLP

(57) ABSTRACT

A gaming machine coupled to at least one server via a network includes a display device configured to display a game to a player playing on the gaming machine, and a controller coupled to the display device. The controller detects an award trigger during play of the game, and awards a token upon detection of the award trigger, wherein the token includes an activation date, an expiration date, and a value that is unknown to the player at the time of being awarded. In response to a redemption request by the player, the controller determines a redemption status of the token and, based on the redemption status, awards the token value to the player or notifies the player that the token is expired.

56 Claims, 13 Drawing Sheets

(56) References Cited

U.S. PATENT DOCUMENTS

| | | | | |
|---|---|---|---|---|
| 7,704,145 | B2 * | 4/2010 | Glisson et al. | 463/25 |
| 7,780,525 | B2 | 8/2010 | Walker et al. | |
| 7,862,426 | B2 | 1/2011 | Walker et al. | |
| 7,878,896 | B2 | 2/2011 | Jorasch et al. | |
| 7,878,901 | B2 | 2/2011 | Walker et al. | |
| 8,167,309 | B1 * | 5/2012 | Laut | 273/250 |
| 2002/0072413 | A1 * | 6/2002 | Arias et al. | 463/42 |
| 2002/0161631 | A1 * | 10/2002 | Banerjee et al. | 705/14 |
| 2003/0092477 | A1 * | 5/2003 | Luciano et al. | 463/16 |
| 2003/0216169 | A1 | 11/2003 | Walker et al. | |
| 2004/0106454 | A1 | 6/2004 | Walker et al. | |
| 2004/0176159 | A1 | 9/2004 | Walker et al. | |
| 2005/0182678 | A1 * | 8/2005 | Walker et al. | 705/14 |
| 2006/0121983 | A1 | 6/2006 | Walker et al. | |
| 2006/0128462 | A1 | 6/2006 | Jorasch et al. | |
| 2006/0205486 | A1 | 9/2006 | Walker et al. | |
| 2006/0252527 | A1 | 11/2006 | Walker et al. | |
| 2007/0032288 | A1 * | 2/2007 | Nelson et al. | 463/16 |
| 2007/0087834 | A1 | 4/2007 | Moser et al. | |
| 2007/0243928 | A1 | 10/2007 | Iddings | |
| 2007/0293309 | A1 | 12/2007 | Jorasch et al. | |
| 2008/0032762 | A1 * | 2/2008 | Kane et al. | 463/16 |
| 2008/0146346 | A1 * | 6/2008 | Hardy et al. | 463/42 |
| 2008/0188292 | A1 | 8/2008 | Walker et al. | |
| 2008/0274792 | A1 * | 11/2008 | Walker et al. | 463/25 |
| 2009/0075727 | A1 * | 3/2009 | Walker et al. | 463/25 |
| 2009/0117993 | A1 * | 5/2009 | Bigelow, Jr. | G07F 17/34 463/22 |
| 2009/0124371 | A1 * | 5/2009 | Gilmore | G07F 17/3258 463/27 |
| 2009/0124384 | A1 * | 5/2009 | Smith | G07F 17/32 463/42 |
| 2009/0131141 | A1 | 5/2009 | Walker et al. | |
| 2009/0137313 | A1 * | 5/2009 | Young | G07F 17/3209 463/31 |
| 2009/0143141 | A1 | 6/2009 | Wells et al. | |
| 2009/0172035 | A1 | 7/2009 | Lessing et al. | |
| 2010/0174600 | A1 | 7/2010 | Walker et al. | |
| 2010/0267444 | A1 | 10/2010 | Walker et al. | |
| 2010/0285869 | A1 * | 11/2010 | Walker | G07F 17/32 463/25 |
| 2010/0304841 | A1 | 12/2010 | Sammon et al. | |
| 2011/0106603 | A1 * | 5/2011 | McCann et al. | 705/14.21 |
| 2011/0130188 | A1 | 6/2011 | Walker et al. | |

OTHER PUBLICATIONS

Written Opinion for Singapore Patent Application No. 201200834-8, dated May 16, 2013. (6 pages).

* cited by examiner

PLAYER REWARD PROGRAM WITH LOYALTY-BASED REALLOCATION

BACKGROUND

The embodiments described herein relate generally to gaming systems and, more particularly, to gaming systems and methods that provide player rewards.

At least some known gaming systems provide players with incentives to visit gambling locations, wherein the incentives are based at least partially on winning outcomes of electronic games. More specifically, a player is required to visit a gambling location or a redemption location to redeem an outcome. For example, at least some known gaming systems award a player for an outcome obtained while playing an online game, and require the player to redeem the outcome at a particular gambling location or redemption location. However, the outcome is known to the player at the completion of game play and generally, the outcome does not expire if they are not redeemed by the player within a specific time period.

Moreover, at least some known gaming systems enable a player to use a prepaid casino account that includes a specified amount of money, time, and/or game plays. At least some of such gaming systems require the player to use the specified amount of money, time, and/or game plays before a particular date by expiring a predetermined portion of the money, time, and/or game plays during each of a plurality of expiration periods. However, the prepaid casino account does not involve awards that are unknown to the player until a predetermined activation date. Moreover, any game outcome obtained by the player does not expire and the prepaid casino account is not reallocated to other players if the money, time, and/or game plays are not used within the specified amount of time.

BRIEF DESCRIPTION

This Brief Description is provided to introduce a selection of concepts in a simplified form that are further described below in the Detailed Description. This Brief Description is not intended to identify key features or essential features of the claimed subject matter, nor is it intended to be used as an aid in determining the scope of the claimed subject matter.

In one aspect, a gaming machine that is coupled to at least one server via a network is provided. The gaming machine includes a display device configured to display a game to a player playing on the gaming machine, and a controller coupled to the display device. The controller is configured to detect an award trigger during play of the game, and award a token upon detection of the award trigger, wherein the token includes an activation date, an expiration date, and a value that is unknown to the player at the time of being awarded. In response to a redemption request by the player, the controller determines a redemption status of the token and, based on the redemption status, awards the token value to the player or notifies the player that the token is expired.

In another aspect, a gaming system is provided, and includes a plurality of gaming machines and at least one server coupled to the gaming machines via a network. Each gaming machine includes a display device configured to display a game and player account information to a player. The server is configured to detect an award trigger during play of the game at one of the gaming machines, and award a token to the player upon detection of the trigger, wherein the token includes an activation date, an expiration date, and a value that is unknown to the player at the time of being awarded. The server is also configured to receive a redemption request from the player, determine a redemption status of the token, and based on the redemption status, award the token value to the player or notify the player that the token is expired.

Another aspect provides a method for providing awards in a gaming system that includes at least one gaming machine and at least one server coupled to the gaming machine via a network. The method includes detecting an award trigger during play of the game on the gaming machine, and awarding a token to the player upon detection of the trigger, wherein the token includes an activation date, an expiration date, and a value that is unknown to the player at the time of being awarded. The method also includes receiving a redemption request from the player, and determining a redemption status of the token. In response to a determination that the redemption status is active, the token value is awarded to the player. In response to a determination that the redemption status is expired, the player is notified that the token is expired.

In yet another aspect, one or more computer-readable storage media are provide having computer-executable components therein for providing awards in a gaming system that includes at least one gaming machine and at least one server coupled to the gaming machine via a network. The components include a game component that causes at least one processor to display a game to a player via the gaming machine, and a detection component that causes at least one processor to detect an award trigger during play of the game on the gaming machine. An award component causes at least one processor to award a token to the player upon detection of the trigger, wherein the token includes an activation date, an expiration date, and a value that is unknown to the player at the time of being awarded. An award redemption component causes at least one processor to receive a redemption request from the player, determine a redemption status of the token and, based on the redemption status, award the token value to the player or notify the player that the token is expired.

BRIEF DESCRIPTION OF THE DRAWINGS

The embodiments described herein may be better understood by referring to the following description in conjunction with the accompanying drawings.

DETAILED DESCRIPTION

Figure 1:
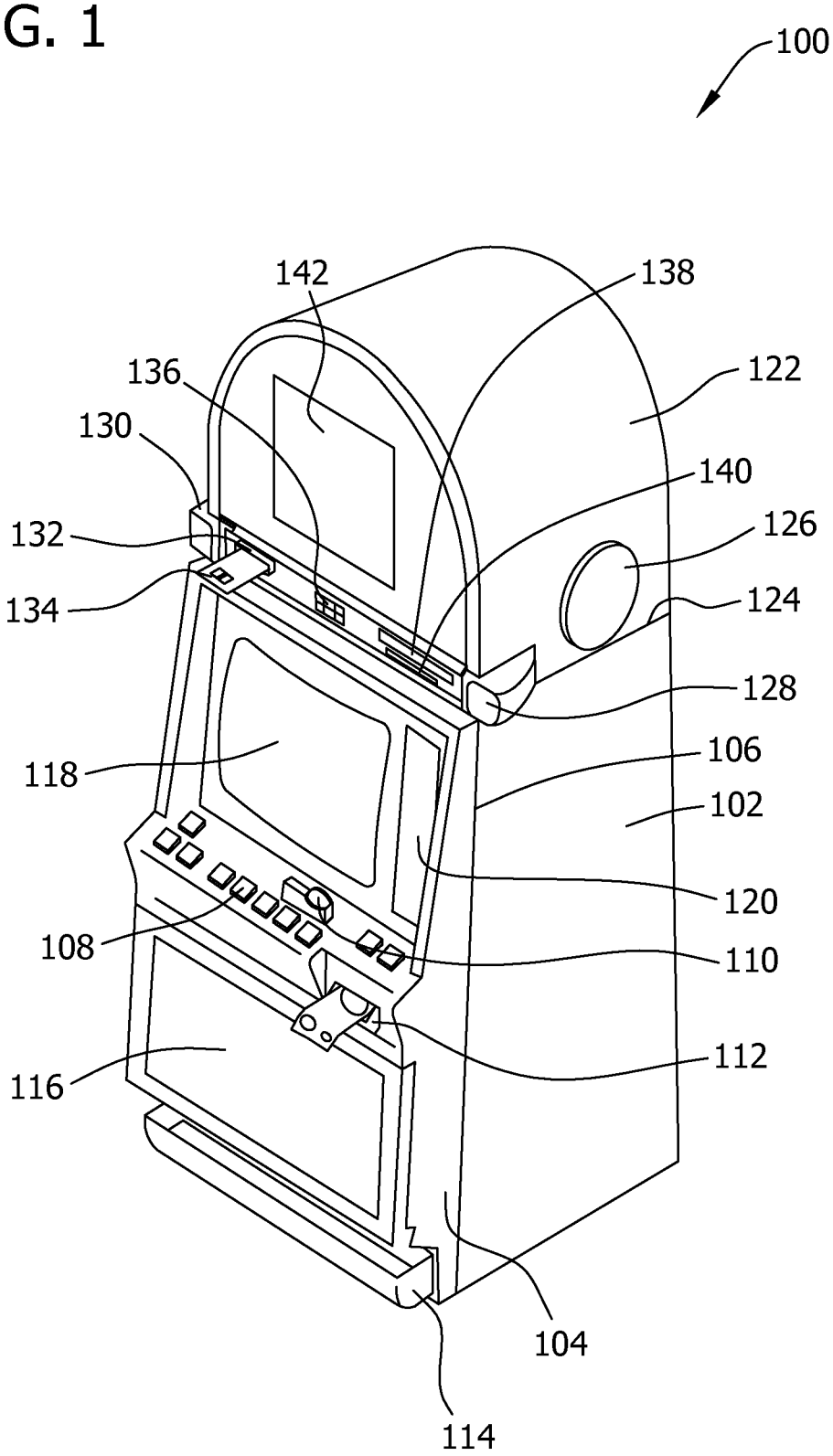
FIG. 1 is a perspective view of an exemplary gaming machine.

Exemplary embodiments of apparatus, systems, methods, and computer-readable storage media for awarding tokens during game play are described above in detail. The apparatus, systems, methods, and storage media are not limited to the specific embodiments described herein but, rather, steps of the methods and/or components of the system and/or apparatus may be utilized independently and separately from other steps and/or components described herein. Further, the described steps and/or components may also be defined in, or used in combination with, other systems, methods, and/or apparatus, and are not limited to practice with only the systems, methods, and storage media as described herein.

A gaming machine or gaming system server, such as those described herein, includes at least one processor or processing unit and a system memory. The gaming machine or gaming system typically has at least some form of computer readable media. By way of example and not limitation, computer readable media include computer storage media and communication media. Computer storage media include volatile and nonvolatile, removable and non-removable media implemented in any method or technology for storage of information such as computer readable instructions, data structures, program modules, or other data. Communication media typically embody computer readable instructions, data structures, program modules, or other data in a modulated data signal such as a carrier wave or other transport mechanism and include any information delivery media. Those skilled in the art are familiar with the modulated data signal, which has one or more of its characteristics set or changed in such a manner as to encode information in the signal. Combinations of any of the above are also included within the scope of computer readable media.

Although the present invention is described in connection with an exemplary gaming system environment, embodiments of the invention are operational with numerous other general purpose or special purpose gaming system environments or configurations. The gaming system environment is not intended to suggest any limitation as to the scope of use or functionality of any aspect of the invention. Moreover, the gaming system environment should not be interpreted as having any dependency or requirement relating to any one or combination of components illustrated in the exemplary operating environment. Examples of well known gaming systems, environments, and/or configurations that may be suitable for use with aspects of the invention include, but are not limited to, personal computers, server computers, hand-held or laptop devices, multiprocessor systems, microprocessor-based systems, set top boxes, programmable consumer electronics, mobile telephones, network PCs, minicomputers, mainframe computers, distributed computing environments that include any of the above systems or devices, and the like.

Embodiments of the invention may be described in the general context of computer-executable instructions, such as program components or modules, executed by one or more computers or other devices. Aspects of the invention may be implemented with any number and organization of components or modules. For example, aspects of the invention are not limited to the specific computer-executable instructions or the specific components or modules illustrated in the figures and described herein. Alternative embodiments of the invention may include different computer-executable instructions or components having more or less functionality than illustrated and described herein.

The order of execution or performance of the operations in the embodiments of the invention illustrated and described herein is not essential, unless otherwise specified. That is, the operations may be performed in any order, unless otherwise specified, and embodiments of the invention may include additional or fewer operations than those disclosed herein. For example, it is contemplated that executing or performing a particular operation before, contemporaneously with, or after another operation is within the scope of aspects of the invention.

In some embodiments, a processor includes any programmable system including systems and microcontrollers, reduced instruction set circuits (RISC), application specific integrated circuits (ASIC), programmable logic circuits (PLC), and any other circuit or processor capable of executing the functions described herein. The above examples are exemplary only, and thus are not intended to limit in any way the definition and/or meaning of the term processor.

In some embodiments, a database includes any collection of data including hierarchical databases, relational databases, flat file databases, object-relational databases, object oriented databases, and any other structured collection of records or data that is stored in a computer system. The above examples are exemplary only, and thus are not intended to limit in any way the definition and/or meaning of the term database. Examples of databases include, but are not limited to only including, Oracle® Database, MySQL, IBM® DB2, Microsoft® SQL Server, Sybase®, and PostgreSQL. However, any database may be used that enables the systems and methods described herein. (Oracle is a registered trademark of Oracle Corporation, Redwood Shores, Calif.; IBM is a registered trademark of International Business Machines Corporation, Armonk, N.Y.; Microsoft is a registered trademark of Microsoft Corporation, Redmond, Wash.; and Sybase is a registered trademark of Sybase, Dublin, Calif.)

When introducing elements of aspects of the invention or embodiments thereof, the articles "a," "an," "the," and "said" are intended to mean that there are one or more of the elements. The terms "comprising," including," and "having" are intended to be inclusive and mean that there may be additional elements other than the listed elements.

Technical effects of apparatus, methods, systems, and computer-readable media described herein include at least one of (a) receiving player registration details for use by player tracking and token management servers in a gaming system; (b) initiating game play; (c) detecting an award trigger during game play; (d) awarding a token to the player, wherein the token includes an activation date, an expiration date, and a nonredeemable value upon being awarded, and wherein the token value is unknown to at least the player upon being awarded; (e) comparing a current date with the activation date, and notifying the player that the token is active; (f) comparing the current date with the expiration date, and notifying the player that the token is expired or is about to expire; (g) receiving a redemption request from the player, and determining a redemption status; (h) awarding the token to the player if the redemption status of the token is active; (i)

notifying the player that the token is expired if the redemption status of the token is expired; and (j) reallocating token values of expired tokens to one or more other players.

Figure 2:
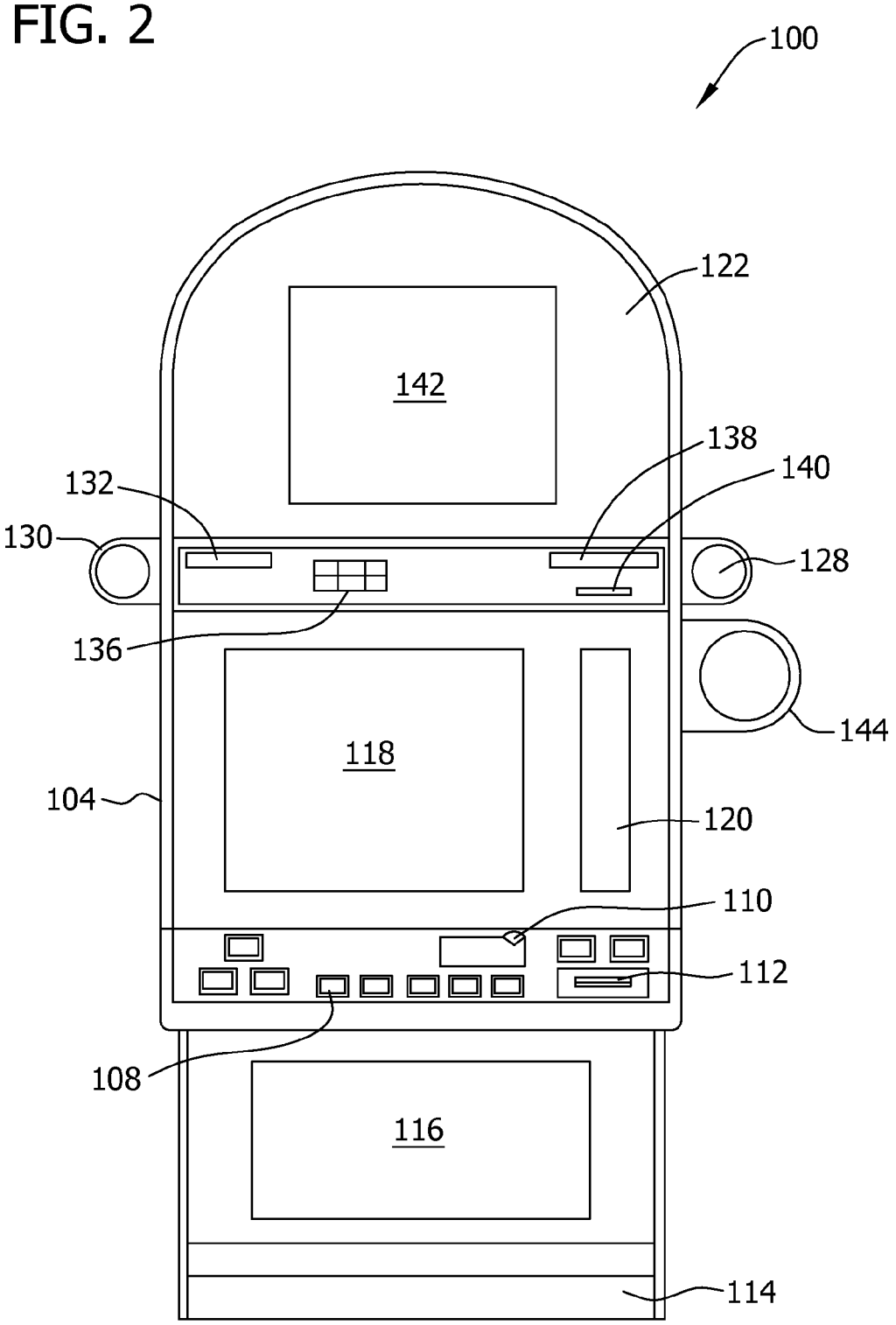
FIG. 2 is a front view of the gaming machine shown in FIG. 1.

FIGS. 1 and 2 are schematic diagrams of an exemplary gaming machine 100 that provides redeemable award opportunities, or tokens, during play of a game. Specifically, FIG. 1 is a perspective view of gaming machine 100, and FIG. 2 is a front view of gaming machine 100. Gaming machine 100 may be any type of gaming machine, and may include, without limitation, different structures than those shown in FIGS. 1 and 2. Moreover, gaming machine 100 may employ different methods of operation than those described below.

In the exemplary embodiment, gaming machine 100 includes a main cabinet 102 having a main door 104 coupled to a front 106 of gaming machine 100. When opened, door 104 provides access to an interior (not shown) of gaming machine 100. In the exemplary embodiment, a plurality of player-input switches and/or buttons 108 is coupled to main door 104. Moreover, in the exemplary embodiment, a coin acceptor 110, for accepting coins and/or tokens, a bill acceptor 112, for accepting and/or validating cash bills, coupons and/or ticket vouchers, a coin tray 114, for collecting a coin-based payout, and a belly glass 116 are each coupled to main door 104. A primary display device 118 and an information panel 120 are viewable through main door 104. Primary display device 118 may be implemented as a cathode ray tube (CRT), a flat-panel liquid crystal display (LCD), a plasma display, an organic light-emitting diode (OLED) display, a multi-layer display (MLD), or any other electronically-controlled video monitor. Moreover, primary display device 118 may include touch screen capabilities. In the exemplary embodiment, information panel 120 is a back-lit, silk screened glass panel that includes lettering to indicate general game information including, for example, a number of coins wagered. Coin acceptor 110, bill acceptor 112, player-input buttons 108, video display monitor 118, and information panel 120 are each used by a player to play a game on gaming machine 100. Each component 108, 110, 112, 118, and/or 120 is controlled by a gaming machine controller (not shown in FIG. 1) that is housed inside main cabinet 102. Numerous games including, but not limited to only including, video slot games, video poker, video pachinko, video black jack, video card games, and/or video keno may be implemented for play on gaming machine 100.

In the exemplary embodiment, gaming machine 100 also includes a top box 122 that is positioned on a top surface 124 of main cabinet 102. In the exemplary embodiment, top box 122 includes a number of devices that may be used to add features to a game being played on gaming machine 100. Such devices may include, but are not limited to only including, speakers 126, 128, and 130, a ticket printer 132 for printing bar-coded tickets 134, a key pad 136 for entering player tracking information, or player preferences or characteristics, a display 138 for displaying player tracking information and/or player preferences or characteristics, and a card reader 140 for receiving a card containing player tracking information and/or player preferences or characteristics encoded thereon. Card reader 140 may also be used to accept credit cards, printed cards, smart cards, and/or other magnetic stripe cards. Moreover, top box 122 includes a secondary display device 142 that displays, for example, player information, an attract sequence, a bonus game, or any other suitable images. Secondary display device 142 may be implemented as a cathode ray tube (CRT), a flat-panel liquid crystal display (LCD), a plasma display, an organic light-emitting diode (OLED) display, a multi-layer display (MLD), or any other electronically-controlled video monitor. Moreover, secondary display device 142 may include touch screen capabilities. Top box 122 may house additional devices not shown in FIG. 1, such as, for example, a bonus wheel and/or a back-lit silk screened panel that may be used to add bonus features to a game being played on gaming machine 100. During game play, such devices may be controlled by circuitry, such as the gaming machine controller housed within main cabinet 102.

In the exemplary embodiment, gaming machine 100 includes a player account interface. The player account interface may be displayed via primary display device 118, secondary display device 142, or, as shown in FIG. 2, gaming machine 100 may include a retrofit unit 144. As described in greater detail below, the player account interface displays player information and/or player account information to a player, including details related to redeemable award tokens.

Figure 3:
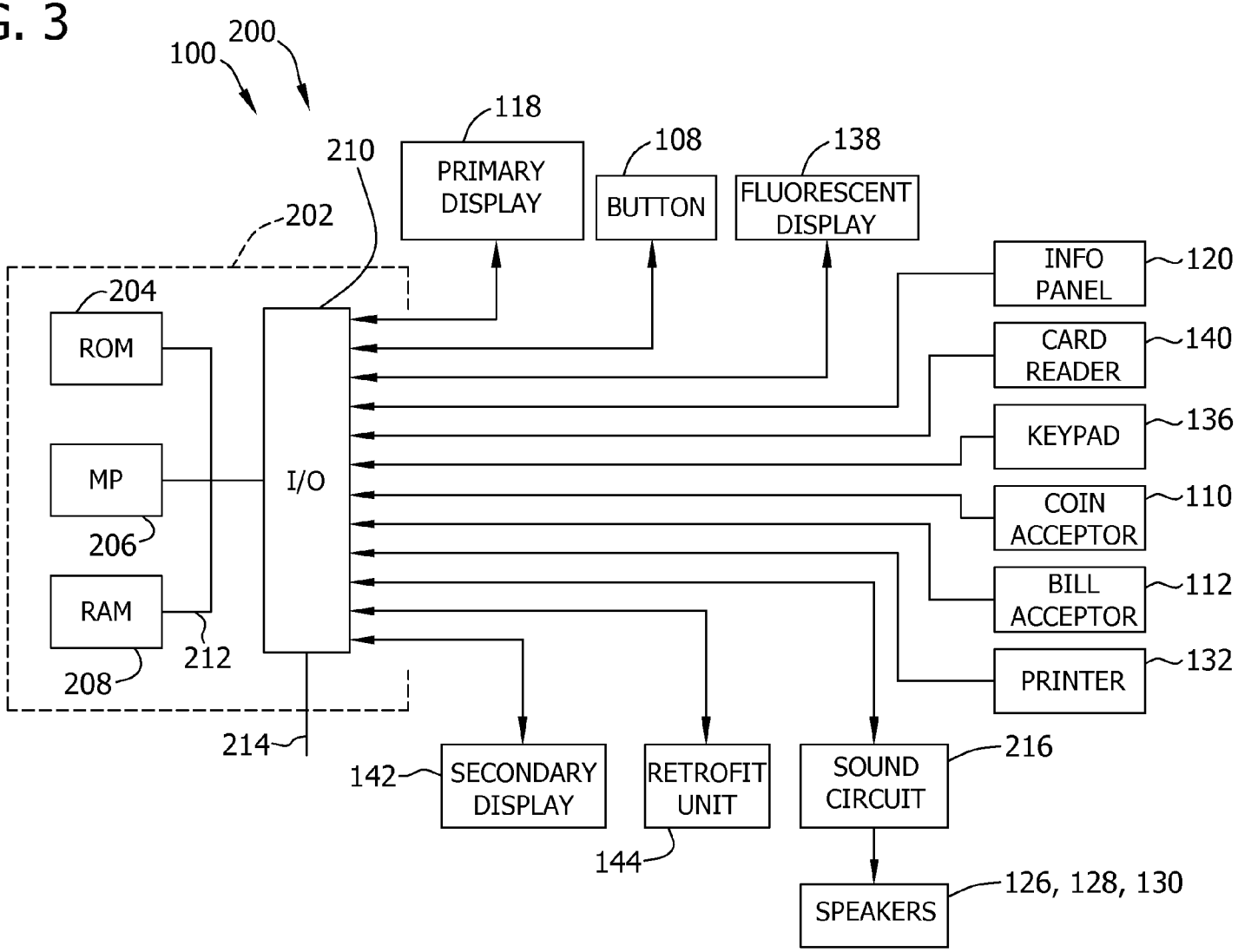
FIG. 3 is a block circuit diagram of an exemplary electrical architecture that may be used with the gaming machine shown in FIGS. 1 and 2.

FIG. 3 is a block circuit diagram of an exemplary electrical architecture 200 incorporated into an exemplary gaming machine, such as gaming machine 100. In the exemplary embodiment, gaming machine 100 includes a gaming machine controller 202 that includes a read-only memory (ROM) 204, a microcontroller or microprocessor (MP) 206, a random-access memory (RAM) 208, and an input/output (I/O) circuit 210, each coupled via an address/data bus 212. As used herein, the terms "controller" and "processor" may include any programmable system including systems using microcontrollers, reduced instruction set circuits (RISC), application specific integrated circuits (ASICs), logic circuits, and any other circuit or processor capable of executing the functions described herein. The above examples are exemplary only, and are thus not intended to limit in any way the definition and/or meaning of the terms "controller" or "processor". Alternative embodiments of controller 202 may include more than one microprocessor 206, multiple RAM modules 208, and/or multiple ROM modules 204. Moreover, although I/O circuit 210 is shown in FIG. 2 as a single component, one of ordinary skill in the art will appreciate that I/O circuit 210 may include any number or a plurality of different types of I/O circuits. Further, RAM 208 and/or ROM 204 may be implemented as, for example, semiconductor memories, magnetically readable memories, and/or optically readable memories. In one embodiment, each operational component of gaming machine 100 is coupled to I/O circuit 210 via a respective conductor and/or via bus 212. Alternative embodiments may include a single coupling between the operational components of gaming machine 100 and I/O circuit 210. In the exemplary embodiment, I/O circuit 210 is coupled to a gaming network (not shown) via a network interface 214. Moreover, in the exemplary embodiment, architecture 200 includes a sound circuit 216 that generates audio signals and that communicates the audio signals between I/O circuit 210 and speakers 126, 128, and/or 130.

Figure 4:
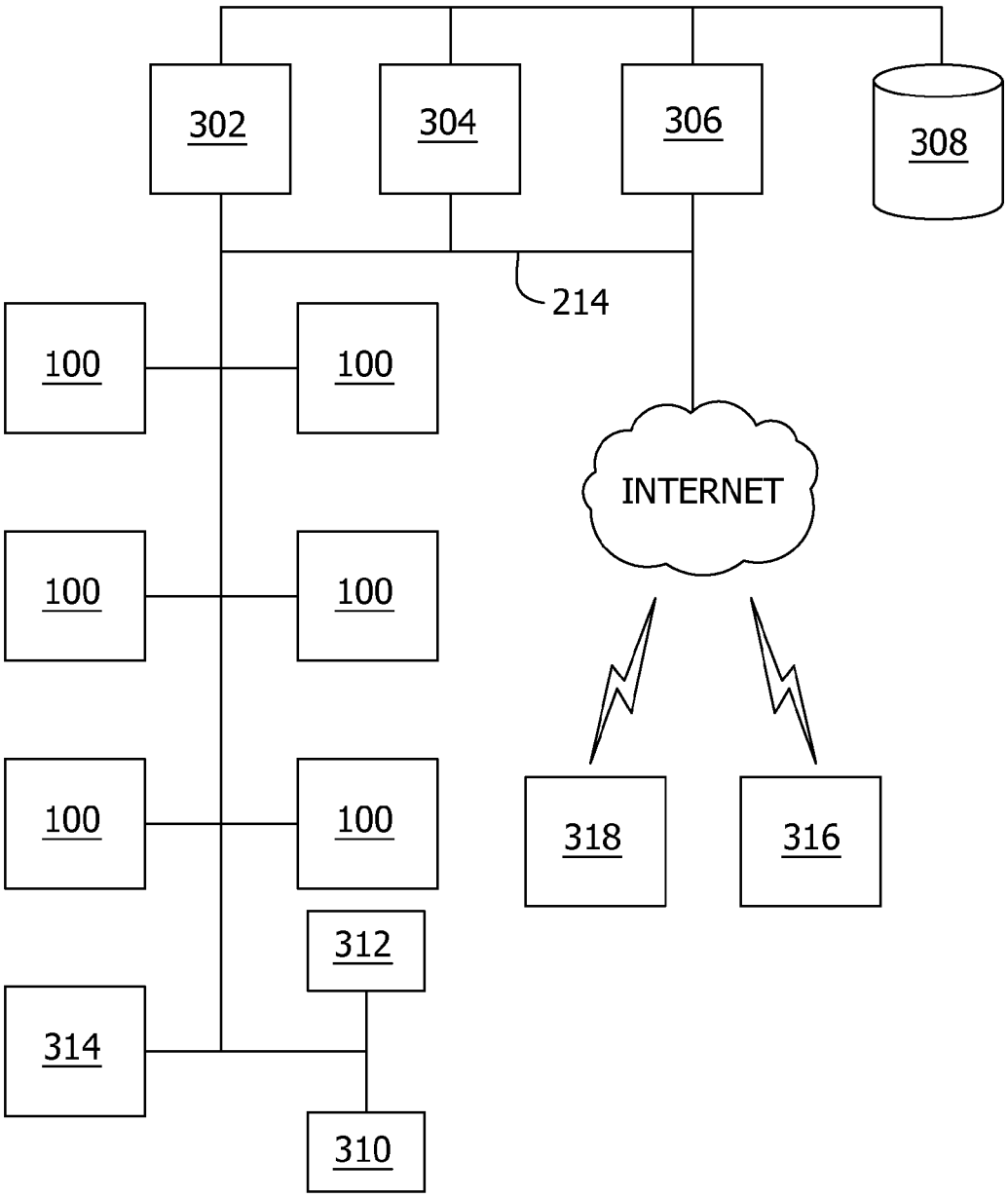
FIG. 4 is a block schematic diagram of an exemplary gaming system.

FIG. 4 is a block schematic diagram of an exemplary gaming system 300 that includes a plurality of gaming machines 100. Each gaming machine 100 is coupled via a network connection 214 to one or more servers, such as a token management server 302, an accounting server 304, and a player tracking server 306. Each server 302, 304, and 306 includes a processor (not shown) that facilitates data communication between each gaming machine 100 and other components of gaming system 300. Such data is stored in, for example, a database 308 that is coupled to each server 302, 304, and 306. Moreover, each server 302, 304, and 306 also includes audio capabilities, such as a CD-ROM drive (not shown) or DVD-ROM drive (not shown), that are coupled to a sound card (not shown) for processing and transmitting digitized sound effects to one or more speakers 310 in response to commands issued over gaming system 300 by a corresponding server 302, 304, and/or 306. Each server 302, 304, and 306 is also coupled via gaming system 300 to an electronic sign or screen 312 that displays information, such as via scrolling and/or flashing messages that indicate, for example, progressive and/or jackpot amounts, and that are visible to players playing gaming machines 100. Messages for display on each electronic screen 312 are generated and/or modified in response to commands issued over gaming system 300 by servers 302, 304, and/or 306.

As described above, gaming machines 100 may include video poker machines, video slot machines, and/or other similar gaming machines that implement alternative games. Moreover, gaming machines 100 may be terminal-based machines, wherein the actual games, including random number generation and/or outcome determination, are performed at a server, such as servers 302, 304, and/or 306. In such an embodiment, gaming machine 100 displays results of the game via primary display device 118 (shown in FIG. 1).

Moreover, in the exemplary embodiment, gaming system 300 includes a configuration workstation 314 that includes a user interface that enables an administrator to set up and/or to modify portions of gaming system 300 and/or servers 302, 304, and 306. Player tracking server 306 tracks data of players using gaming machines 100, and also controls messages that appear on each display device 118 and 142 and/or information panel 120 of gaming machines 100. In the exemplary embodiment, player tracking server 306 also stores physical characteristics of players, such as the player age and/or vision data. Token management server 302 controls bonus applications or bonus systems that award token opportunities on gaming system 300. Moreover, token management server 302 includes a set of rules for awarding jackpots in excess of those established by winning pay tables (not shown) of each gaming machine 100. Some bonus awards may be awarded randomly, while other bonus awards may be made to groups of gaming machines 100 operating in a progressive jackpot mode. Player tracking server 306 may store data related to the players tracked by a player tracking identification, such as a player card. Moreover, player tracking server 306 may store information and data about the player such as loyalty points, player address, phone number, and the like that may be retrieved and transmitted to the token management server 302. Accounting server 304 may store and track information such as the average amount of wager played by the player, any funds the player may have in an account, and the like.

Furthermore, gaming system 300 includes one or more remote computers 316 and/or mobile devices 318 that access system 300 via an external network, such as the Internet.

Figure 5:
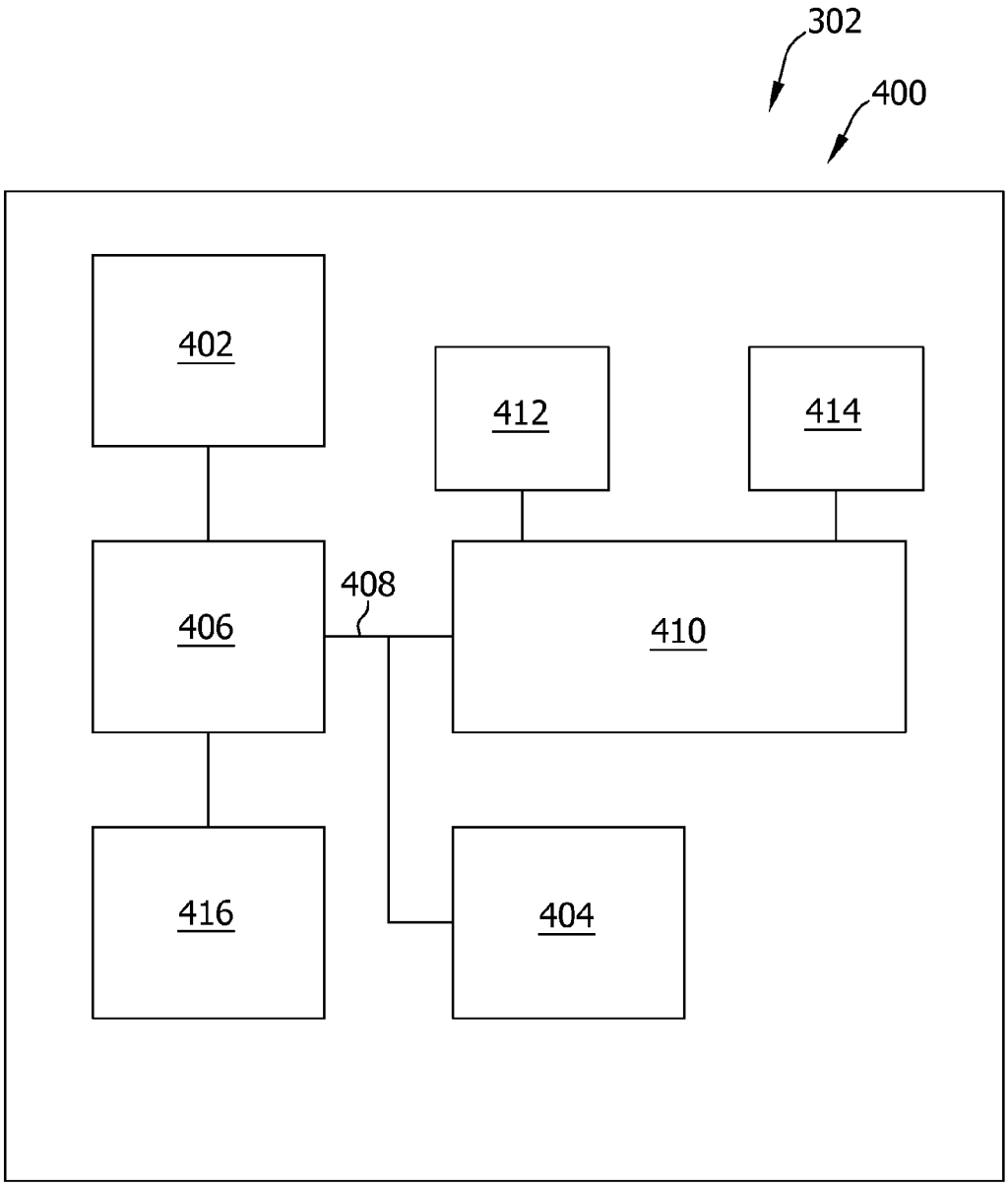
FIG. 5 is a schematic block diagram of an exemplary electrical architecture a of token management server that may be used with the gaming system shown in FIG. 4.

FIG. 5 is a schematic block diagram of an exemplary electrical architecture 400 of token management server 302. In the exemplary embodiment, token management server 302 includes a network interface 402 that facilitates communication between server 302 and gaming system 300 (shown in FIG. 4). Interface 402 is not intended to be limiting as any combination of hardware and software may be used as desired to allow the various input/output devices to communicate with token management server 302. Moreover, token management server 302 includes one or more memory modules 404, such as a read-only memory (ROM) and/or a random-access memory (RAM). Memory 404 is coupled to a microcontroller or central processor unit (CPU) via an address/data bus 408. As used herein, the terms "controller" and "processor" may include any programmable system including systems using microcontrollers, reduced instruction set circuits (RISC), application specific integrated circuits (ASICs), logic circuits, and any other circuit or processor capable of executing the functions described herein. The above examples are exemplary only, and are thus not intended to limit in any way the definition and/or meaning of the terms "controller" or "processor". Alternative embodiments of architecture 400 may include more than one processor 406 and/or multiple memory modules 404. Further, memory 404 may be implemented as, for example, semiconductor memory, magnetically readable memory, and/or optically readable memory.

In some embodiments, token management server 302 also includes a configuration manager 410 that enables a user to setup, configure, and/or modify various token awards 412 that are offered and qualifying criteria 414 that must be met to be offered to the player. Qualifying criteria 414 may be any parameters such as game theme, denomination, location in the casino, bonus length, player data, prizes offered, bonus type, bonus acceptance time, or any other desired qualifying criteria. Configuration manager 410 may be used in cooperation with or configuration workstation 314 (shown in FIG. 4).

In the exemplary embodiment, token management server 302 also includes a token communicator 416 that is coupled to processor 406. Token communicator 416 gathers the necessary data and information associated with token awards and players from accounting server 304 and player tracking server 306 (both shown in FIG. 4). In some embodiments, a casino may have separate systems for player tracking, accounting, cage and credit system, and the like. Thus, in order for the various token awards to be offered, token management server 302 communicates and obtains information from each of the various systems. For example, token communicator 416 communicates with player tracking server 306 to retrieve information about the player to determine the player's eligibility to receive a token, as described in more detail below.

Figure 6:
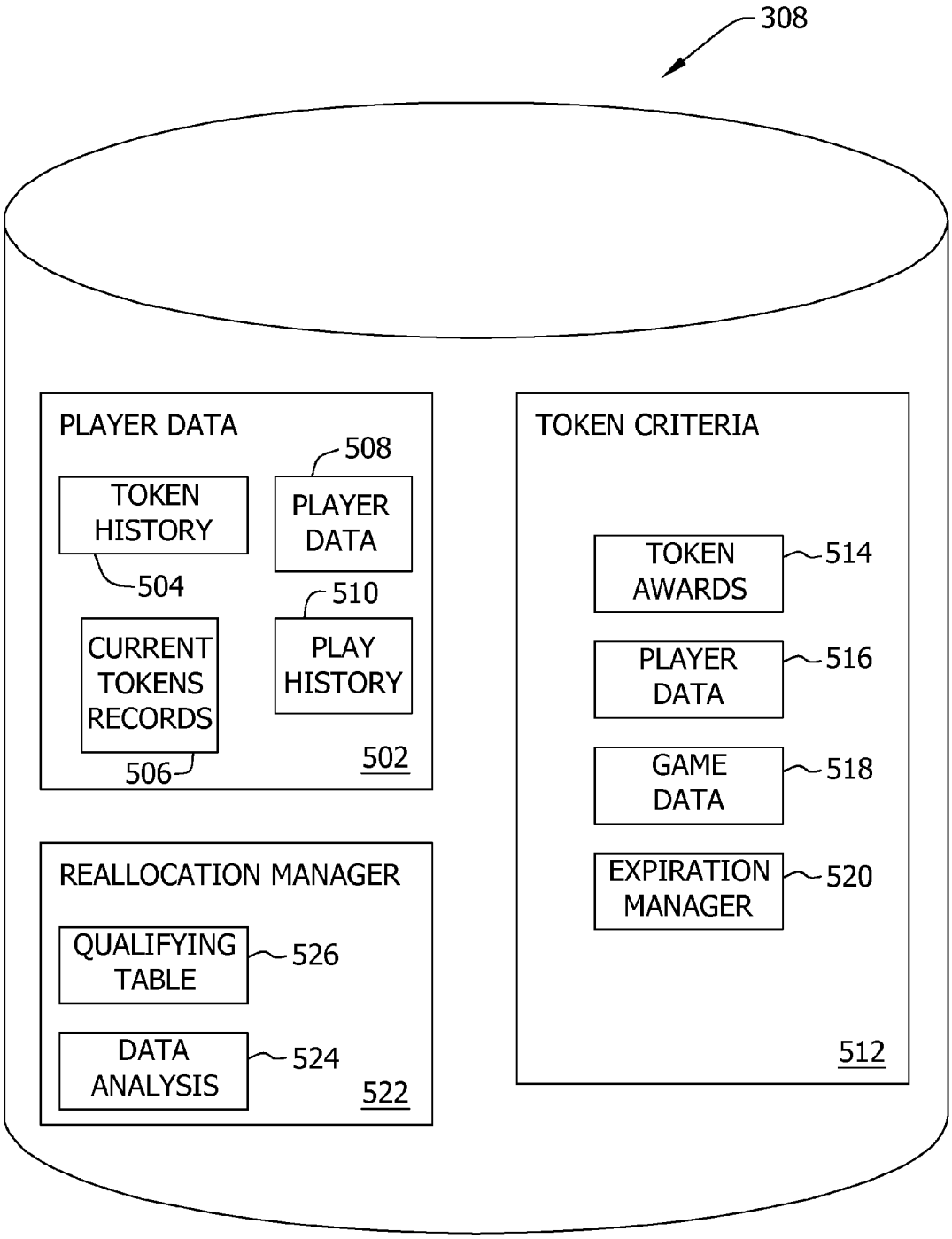
FIG. 6 is a schematic block diagram of a plurality of data storage tables of an exemplary database that may be used with the gaming system shown in FIG. 4.

FIG. 6 is a schematic block diagram of a plurality of data storage tables of database 308. In some embodiments, database 308 may be implemented by a plurality of databases 308. In the exemplary embodiment, database 308 stores player data 502 such as a player's token history 504. Tokens that the player was awarded previously may be saved in the database 308 and may be used to determine and/or customize future bonuses offered to the player. Current token records 506 may also be saved in database 308.

Player data records 508 may be obtained from player tracking server 306 (shown in FIG. 4) and saved in database 308. The information includes a player's ratings, number of points accumulated in the loyalty program, the player's residence, and any other information necessary to determine the player's eligibility to receive a token. Additionally, play history records 510 may be stored in database 308. Play history records 510 may be used to customize the bonuses offered to the player to keep a player's interest in playing a game of chance.

Database 308 also stores token criteria 512, which may be any information used to determine whether a player is qualified to receive a particular token 514. Token criteria records 512 may be based upon player data records 516, a type of game played 518, a predetermined time frame stored in a token expiration manager 520, or any other token criteria 512.

Processor 406 (shown in FIG. 5) may be configured to execute reallocation manager 522 that determines whether a token is expired and whether the token should be reallocated to one or more other players. Reallocation manager 522 includes a data analysis application 524 that analyzes and determines whether a token is active or expired, and/or whether an expired token should be reallocated to other players. If it is determined that the expired token should be reallocated, data analysis application 524 determines how the expired token should be reallocated and to which player or players the expired token should be reallocated according to a qualifying table 526.

Figure 7:
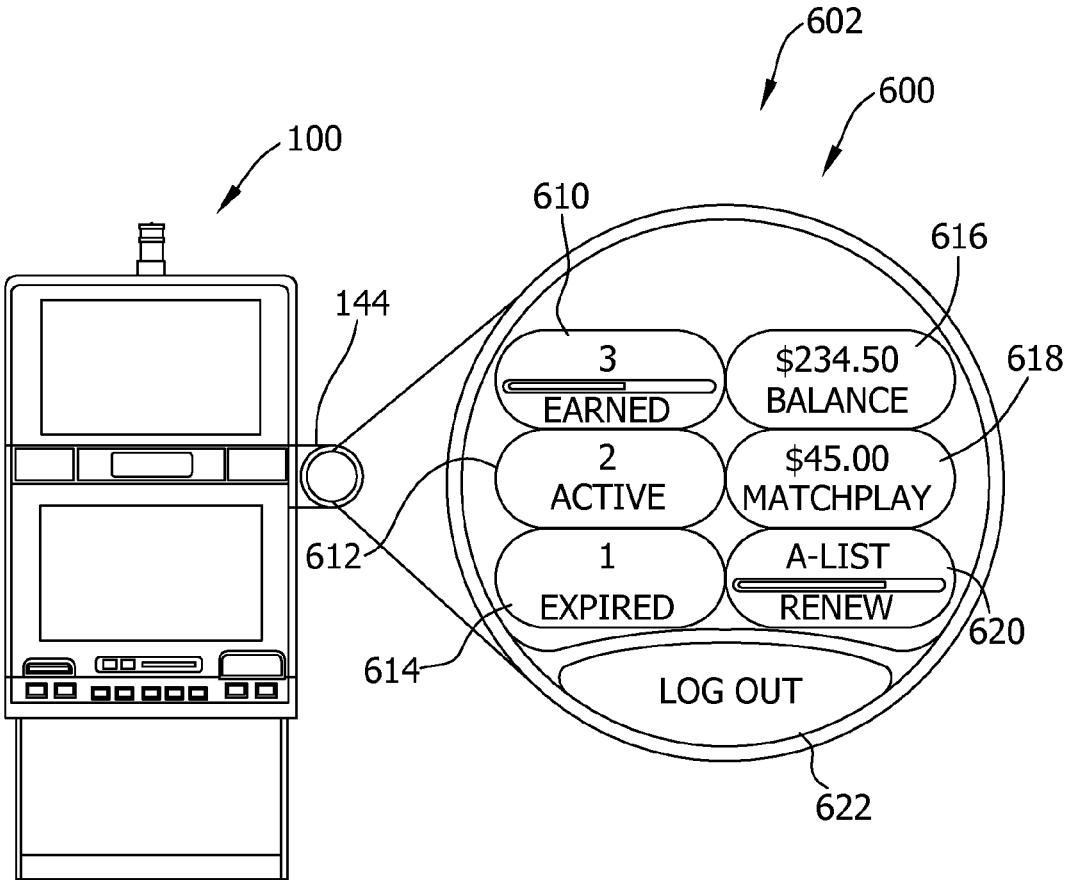
FIG. 7 is a diagram that illustrates a top level view of an exemplary player account interface.
Figure 8:
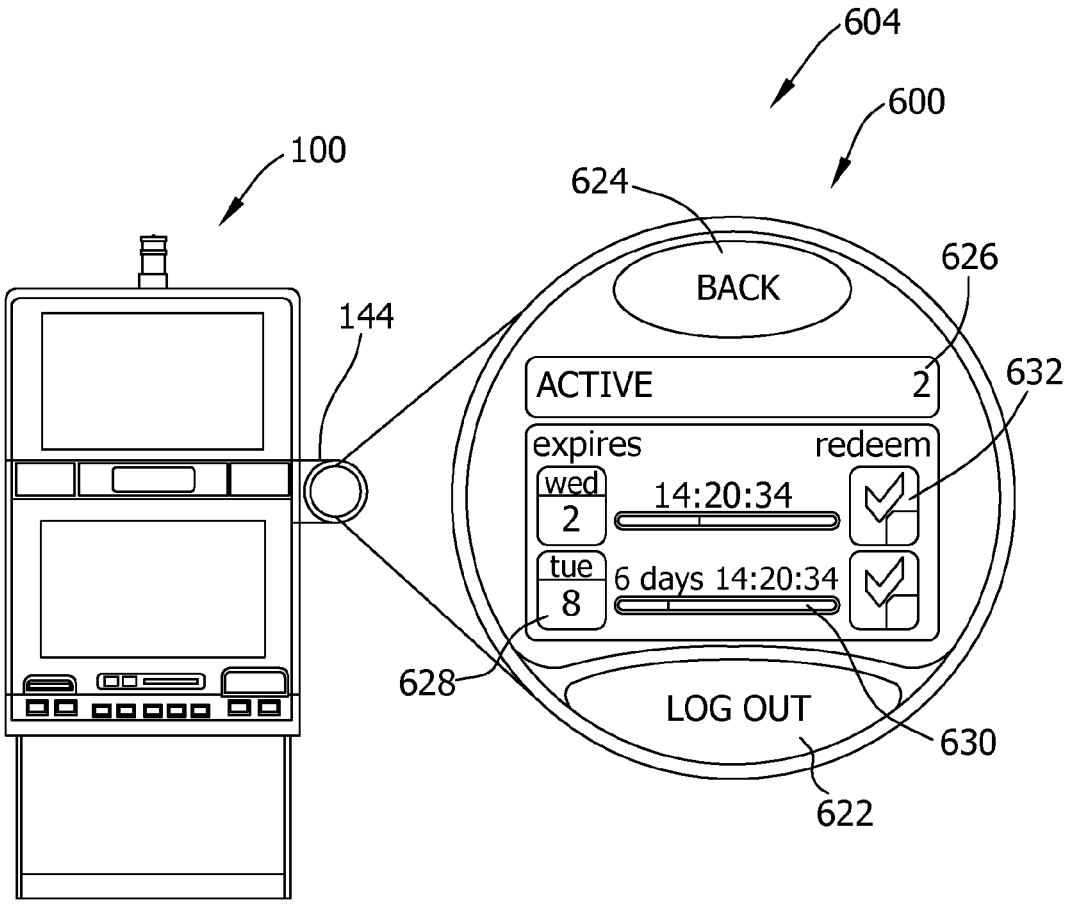
FIG. 8 is a diagram that illustrates an active token view of the player account interface shown in FIG. 7.
Figure 9:
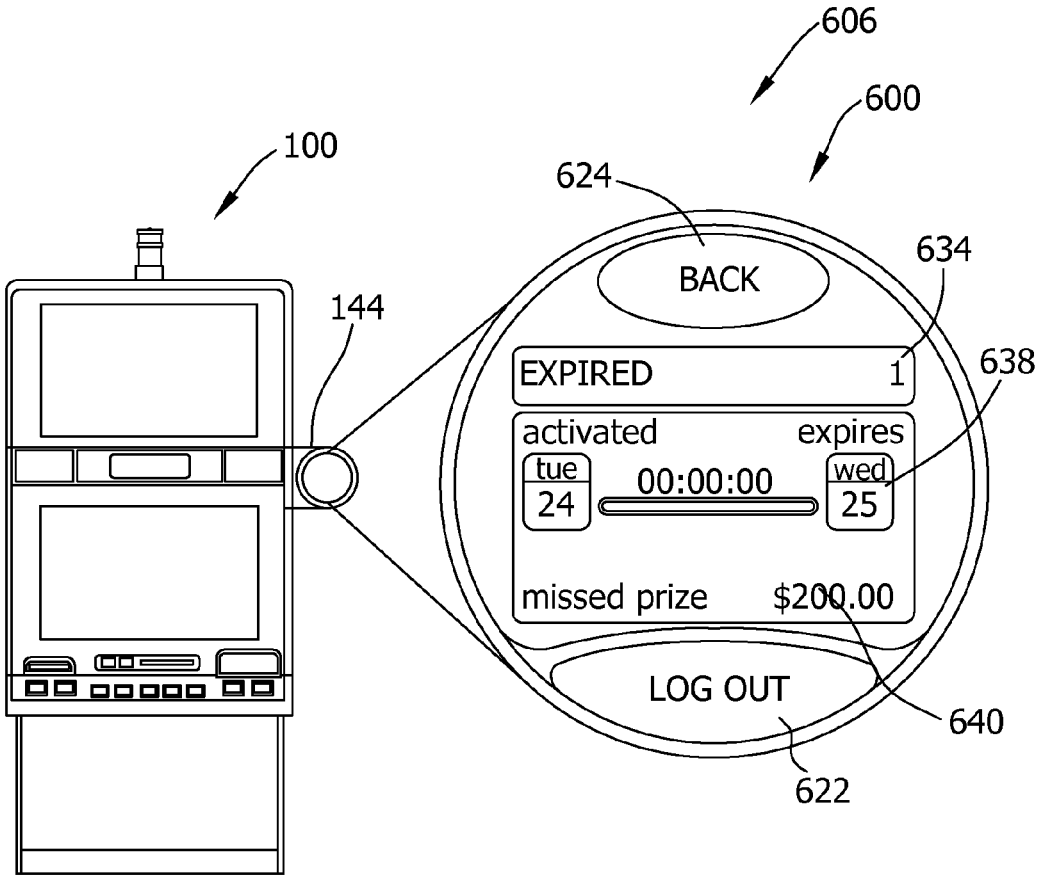
FIG. 9 is a diagram that illustrates an expired token view of the player account interface shown in FIG. 7.
Figure 10:
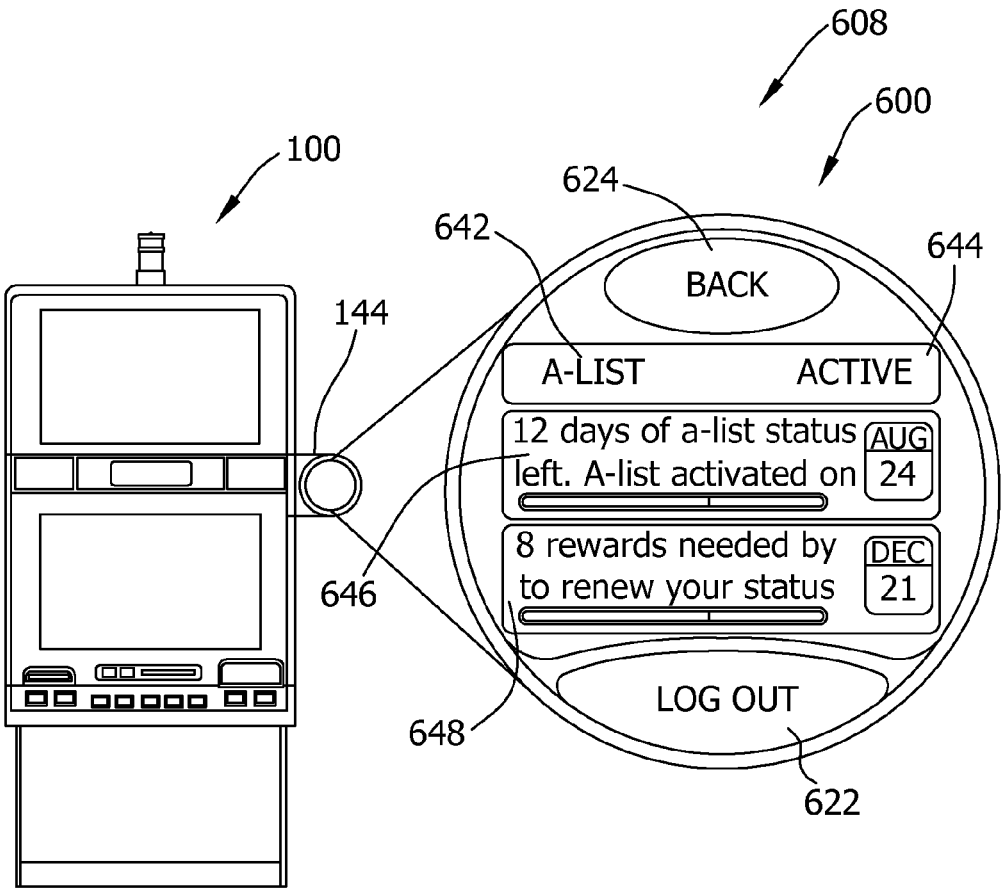
FIG. 10 is a diagram that illustrates a player level view of the player account interface shown in FIG. 7.

FIGS. 7-10 are diagrams of an exemplary player account interface 600 that may be used with a gaming machine, such as gaming machine 100. Specifically, FIG. 7 illustrates a top level view 602 of player account interface 600; FIG. 8 illustrates an active token view 604 of player account interface 600; FIG. 9 illustrates an expired token view 606 of player account interface 600; and FIG. 10 illustrates a player level view 608 of player account interface 600.

As shown in FIG. 7, top level view 602 includes a first portion 610 for displaying a number of tokens earned, a second portion 612 for displaying a number of active tokens, and a third portion 614 for displaying a number of expired tokens. Moreover, top level view 602 includes a fourth portion 616 for displaying a balance of a player's account, a fifth portion 618 for displaying a match play balance, and a sixth portion 620 for displaying a player level. Each view 602, 604, 606, and 608 of player interface 600 also includes a log out button 622 that enables a player to log out of, for example, a player tracking system or a player tracking subsystem within gaming system 300 (shown in FIG. 4). In addition, active token view 604, expired token view 606, and player level view 608 each include a back button 624. As shown in FIG. 8, interface active token view 604 includes a first portion 626 for displaying the number of active tokens. Active token view 604 also includes, for each active token, a second portion 628 for displaying an expiration date, a third portion 630 for displaying an amount of time until the token expires, and a fourth portion 632 for displaying a redemption request button. In an alternative embodiment, active token view 604 also includes an extension request button (not shown) that enables a player to request an extension for redeeming an active token.

In the exemplary embodiment, and as shown in FIG. 9, expired token view 606 includes a first portion 634 for displaying the number of expired tokens. Expired token view 606 also includes, for each expired token, a second portion 636 for displaying an activation date of the token, a third portion 638 for displaying an expiration date of the token, and a third portion 640 for displaying an award that was associated with the expired token. In an alternative embodiment, expired token view 606 also includes an extension request button (not shown) that enables a player to request an extension for redeeming an expired token. In the exemplary embodiment, and as shown in FIG. 10, player level view 608 includes a first portion 642 for displaying a player level for the player, and a second portion 644 for displaying a status for that player level. Player level view 608 also includes a third portion 646 for displaying a number of days left at the specified status, and a date on which the status started. Moreover, player level view 608 includes a fourth portion 648 for displaying a number of tokens needed to renew the current status and a date by which the tokens must be earned.

Figure 11:
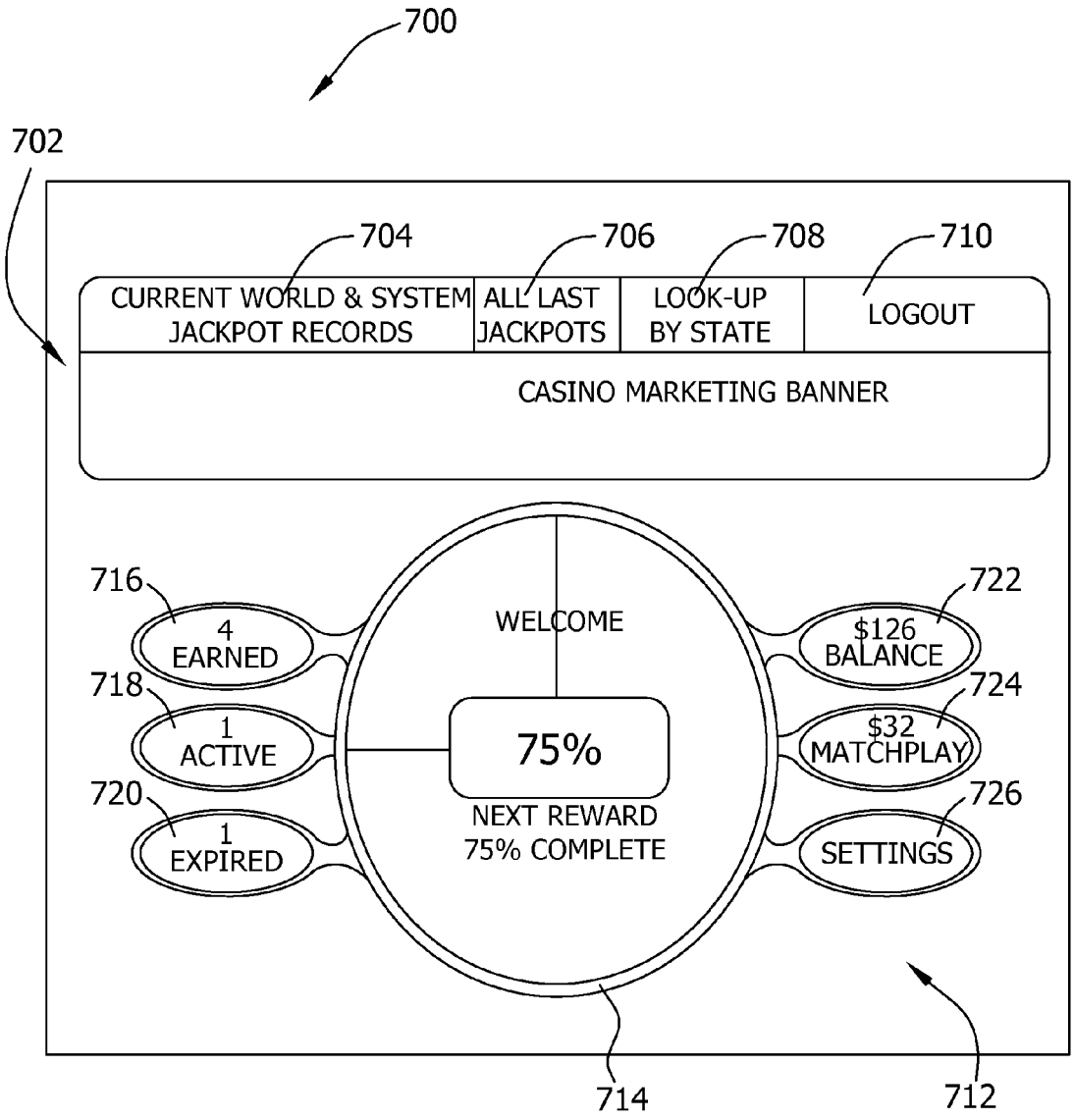
FIG. 11 is a diagram that illustrates a first remote view of player account information available to players via a remote computer that may be used with the gaming system shown in FIG. 4.

FIG. 11 is a first remote view 700 of player account information available to players via, for example, remote computer 316 (shown in FIG. 4). In the exemplary embodiment, first remove view 700 includes a top portion 702 that includes, without limitation, a first link 704 to current jackpot data stored within gaming system 300 (shown in FIG. 4), a second link 706 to jackpot history stored within gaming system 300, a third link 708 for use in locating participating gaming machines 100 (shown in FIG. 1) within gaming system 300 that may be located outside of a particular casino, and a fourth link 710 for use in logging out of gaming system 300. First remote view 700 also includes a second portion 712 for use in displaying the player account information. Specifically, second portion 712 includes a central portion 714 that displays, for example, a welcome message and/or an approximate time until the player earns another token. In the exemplary embodiment, second portion 712 also includes a plurality of buttons for use in drilling down into the player account information, similarly to player account interface 600 (shown in FIGS. 7-10). For example, second portion 712 includes a first button 716 that enables a total number of tokens earned to be displayed, and a second button 718 that enables a number of active tokens to be displayed and enables a player to access a supplementary display with additional details about the active tokens. Second portion 712 also includes a third button 720 that enables a number of expired tokens to be displayed and enables a player to access a supplementary display with additional details about the expired tokens. Moreover, second portion 712 includes a fourth button 722 that enables a balance of a player's account to be displayed, a fifth button 724 that enables a match play balance to be displayed, and a sixth button 726 for use in entering a player settings menu. In an alternative embodiment, second portion 712 also includes an extension request button (not shown) that enables a player to request an extension for redeeming an active token. In another alternative embodiment, the extension request button is presented to the player when viewing details about active tokens and/or expired tokens.

Figure 12:
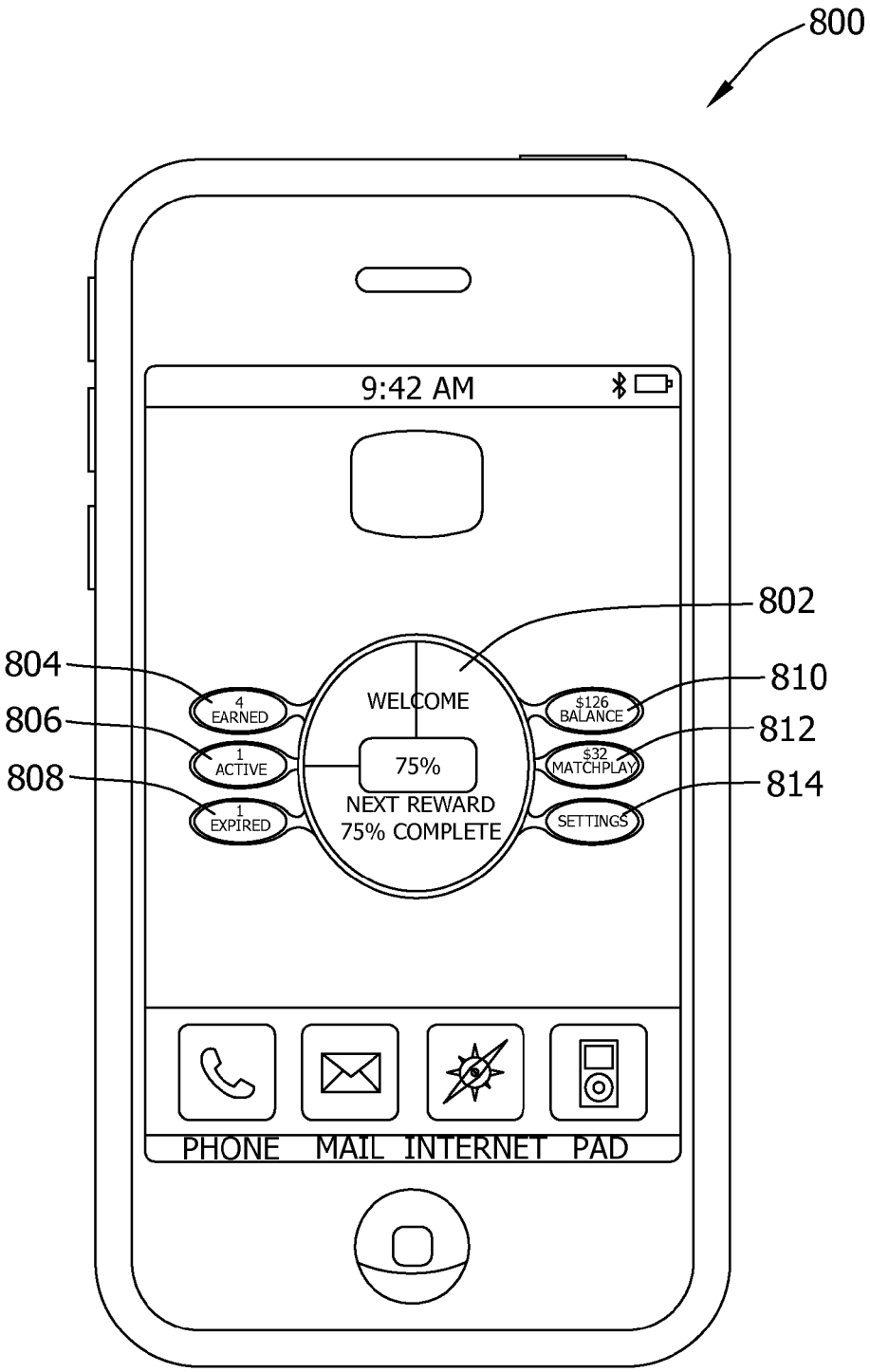
FIG. 12 is a diagram that illustrates a view of a second remote view of player account information available to players via a mobile device that may be used with the gaming system shown in FIG. 4.

FIG. 12 is a view of a second remote view 800 of player account information available to players via, for example, mobile device 318 (shown in FIG. 4). Second remote view 800 is substantially similar to first remote view 700 (shown in FIG. 11). Specifically, second remote view 800 includes a central portion 802 that displays, for example, a welcome message and/or an approximate time until the player earns another token. In the exemplary embodiment, second remote view 800 also includes a plurality of buttons for use in drilling down into the player account information, similarly to player account interface 600 (shown in FIGS. 7-10). For example, second remote view 800 includes a first button 804 that enables a total number of tokens earned to be displayed, and a second button 806 that enables a number of active tokens to be displayed and enables a player to access a supplementary display with additional details about the active tokens. Second remote view 800 also includes a third button 808 that enables a number of expired tokens to be displayed and enables a player to access a supplementary display with additional details about the expired tokens. Moreover, second remote view 800 includes a fourth button 810 for use in displaying a balance of a player's account, a fifth button 812 for use in displaying a match play balance, and a sixth button 814 that enables a player settings menu to be entered. In an alternative embodiment, second remote view 800 also includes an extension request button (not shown) that enables a player to request an extension for redeeming an active token. In another alternative embodiment, the extension request button is presented to the player when viewing details about active tokens and/or expired tokens.

Figure 13:
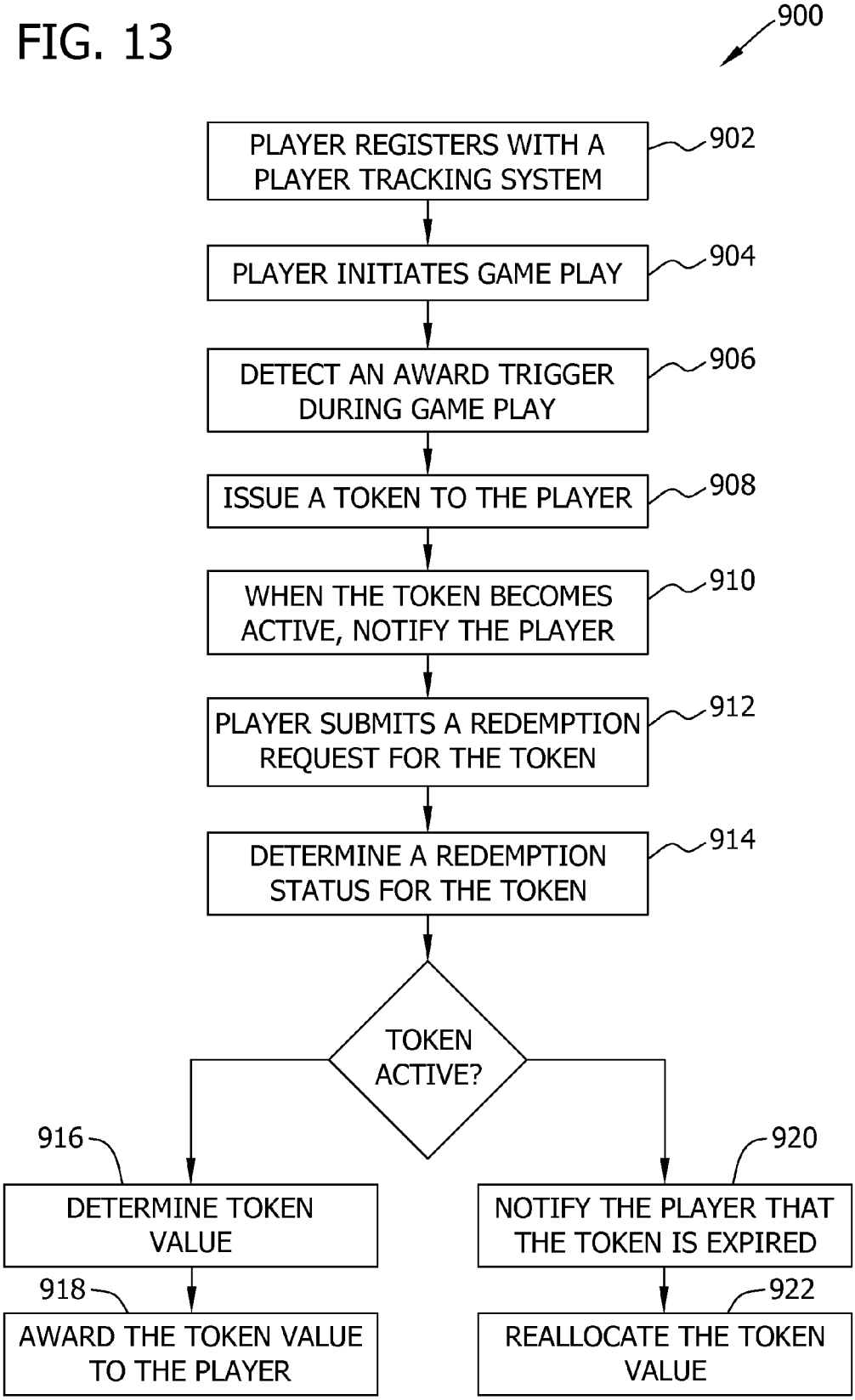
FIG. 13 is a flowchart that illustrates a method for providing awards in a gaming system, such as the gaming system shown in FIG. 4.

FIG. 13 is a flowchart 900 that illustrates a method for providing awards in a gaming system, such as gaming system 300 (shown in FIG. 4). In the exemplary embodiment, a player registers 902 with a player tracking system. Specifically, the player enters information, such as contact information and gaming preferences into, for example, gaming machine 100 (shown in FIGS. 1 and 2). The player enters the information into, for example, a registration user interface that is presented via primary display device 118 (shown in FIGS. 1-3), information panel (shown in FIGS. 1-3), and/or retrofit unit 144 (shown in FIGS. 2 and 3). Alternatively, the player may register via a kiosk (not shown). In some embodiments, the player may register via remote computer 316 or via mobile device 318 (both shown in FIG. 4).

In the exemplary embodiment, the player then initiates 904 play of a game at gaming machine 100. The game is presented to the player via primary display device 118 and/or secondary display device 142 (shown in FIGS. 1-3). During play of the game, gaming machine controller 202 (shown in FIG. 3) detects 906 an award trigger. In an alternative embodiment, token management server 302 (shown in FIG. 4) detects the award trigger. The award trigger may be any game event such as, but not limited to, the presence of a trigger symbol on a wagered payline, the presence of a trigger symbol anywhere in the field of play, a trigger symbol combination on a wagered payline, or a trigger symbol combination on any payline. Moreover, the trigger symbol may be based on an amount of coin in over time, a winnings amount over time, or a losing amount over time. In addition, each of the above examples may be based in part on a player loyalty level, such that players with a higher player level are rewarded with, for example, an award trigger at a lower amount of coin in over time than a player with a lower player level.

In the exemplary embodiment, after detecting an award trigger, a token is issued 908 to the player. In one embodiment, gaming machine controller 202 awards the token. In an alternative embodiment, token management server 302 awards the token. In the exemplary embodiment, gaming machine 100 displays a celebration sequence via primary display device 118 and/or secondary display device 142. The token includes an expiration date, an activation date, and a value. However, in the exemplary embodiment, the token has no redeemable value until the activation date.

Upon arrival of the activation date associated with a token that has been awarded, the player is notified 910 that the token is active and may be redeemed. For example, if the player is involved in a gaming session on the activation date, gaming machine 100 may display a message to the player via primary display device 118, secondary display device 142, and/or retrofit unit 144 that the token is now active and may be redeemed. Alternatively, the player may remotely monitor the status of awarded tokens via remote computer 316 and/or mobile device 318. For example, token management server 302 may send an email or an instant message to the player via remote computer 316, or may send a text message to the player via mobile device 318. In addition, token management server 302 may place an automated phone call to mobile device 318 or to any other a phone number associated with the player. It should be understood that any combination of the above-described notifications may be used to alert the player that a token has become active. In some embodiments, the alert message may also remind the player of the expiration date associated with the token and/or associated with all tokens the player has been awarded. Moreover, the activation date may be based on a player level such that a player with a higher player level has either a shorter or a longer time period between being awarded the token and the activation date than a player with a lower player level.

In the exemplary embodiment, and either after the activation date or on the activation date, the player may redeem one or more tokens that are active. Specifically, the player submits 912 a redemption request via gaming machine 100 or a kiosk. In some embodiments, the player is prompted to log into gaming system 300 via an interface presented on primary display device 118, by inserting a player tracking card into card reader 140 (shown in FIGS. 1 and 2), or via a player account interface presented on retrofit unit 144. After logging into gaming system 300, the player is presented with a message that one or more tokens are active and may be redeemed. In the exemplary embodiment, a redemption status is determined 914 for each token. More specifically, in the exemplary embodiment, token management server 302 determines a redemption status of each token by comparing a current date with the activation date of each token, and by comparing the current date with the expiration date of each token. If the current date is between the activation date and the expiration date, then the token is active and redeemable. If the current date is before the activation date, then the token is not redeemable. If the current date is after the expiration date, then the token is expired. In an alternative embodiment, gaming machine controller 202 determines a redemption status of each token by comparing a current date to the activation date associated with the activation date of each token, and by comparing the current date with the expiration date of each token. If the token is active, token management server 302 determines 916 the token value. In one embodiment, token management server 302 randomly selects the token value from database 308 (shown in FIG. 6). In another embodiment, token management server 302 selects the token value based, at least in part, on a player level. In the exemplary embodiment, the token may have a cash value or a match play value. In an alternative embodiment, the token has a number of player points that are accumulated towards prizes such as hotel rooms, meals, or other non-monetary prizes. In the exemplary embodiment, token management server 302 then awards 918 the token value to the player by, for example, updating the player account with the token value.

In the exemplary embodiment, in response to a determination that the token has expired, the player is notified 920 that the token has expired. Specifically, token management server 302 transmits a message to gaming machine 100 related to the expired status of the token, and gaming machine controller 202 generates an image for display on primary display device 118, secondary display device 142, and/or retrofit unit 144. In some embodiments, the message also includes the token value associated with the expired token. Alternatively, such a message may be displayed to the player, for example, at a kiosk within the casino, via remote computer 316, or via mobile device 318.

In some embodiments, the player may request an extension to the active period. For example, in one embodiment, when gaming machine 100 displays the expired message, the player may initiate a redemption extension request via player account interface 600 (shown in FIGS. 7-10). Alternatively, the player may initiate a redemption extension request via first remote view 700 (shown in FIG. 11) or via second remote view 800 (shown in FIG. 12). Upon receiving the redemption extension request, token management server 302 determines the token value associated with the token. Token management server 302 then reduces the token value by a predetermined amount. For example, the token value may be reduced by a predetermined percentage or by a predetermined number value. Additionally, the reduction to the token value may be based, at least in part, on a player level of the player. Moreover, the reduction to the token value may be based, at least in part, on whether the token is active or whether the token is expired at the time of the redemption extension request. In addition, the redemption extension request may be automatically initiated based on additional play by the player at gaming machine 100. For example, the expiration date may be changed rather than awarding the player a new token during game play. In another example, the expiration date may be changed when the player achieves a higher player level.

Moreover, in some embodiments, the player may utilize player account interface 600 to initiate other transaction types with other players or with gaming system 300. For example, a first player may initiate a trade transaction with a second player in order to acquire a token that expires at a more advantageous time for the first player, such as a later time when the first player will be more able to redeem the token. Upon initiating a trade transaction, gaming machine controller 202 transmits a message to token management server 302, which updates the player accounts of each of the first and second players to reflect the trade. As another example, a first player may initiate a sale transaction with a second player, wherein the second player offers some value to the first player in exchange for an active token. Upon initiating a sale transaction, gaming machine controller 202 transmits a message to token management server 302, which updates the player accounts of each of the first and second players to reflect the sale. As yet another example, a first player may initiate a purchase transaction with a second player, wherein the first player offers some value to the second player in exchange for an active token. Upon initiating a purchase transaction, gaming machine controller 202 transmits a message to token management server 302, which updates the player accounts of each of the first and second players to reflect the purchase.

In the exemplary embodiment, token management server 302 reallocates 922 the value of each expired token. In one embodiment, token management server 302 reallocates an expired token when a player attempts to redeem the token. In an alternative embodiment, token management server 302 periodically monitors the expiration status of all tokens. When a token becomes expired, token management server 302 automatically reallocates the value associated with the expired token. The token values may be reallocated based on one or more of a number of variables. For example, token values may be evenly reallocated only to all players that have a particular player level, e.g., A-list players. Alternatively, token values may be randomly reallocated to all A-list players. As another example, token values may be evenly reallocated to all players having non-expired accounts. Alternatively, token values may be randomly reallocated to all players having non-expired accounts. As another example, token values may be reallocated only to A-list players that have played within a specific time period, or to any player that has played within the specific time. As yet another example, token values may be reallocated to top rated players within a particular player level, such as players having the highest number of player points or the most tokens awarded. Moreover, token values may be reallocated in proportion to an account value of each non-expired account. It should be understood that any of the above reallocation schemes may be used in alone or in combination. Moreover, any other suitable reallocation scheme may be used in alone or in combination with the above reallocation schemes.

In some embodiments, players may set and/or modify player account settings related to tokens awarded. The player may set and/or modify the settings using player account interface 600 via gaming machine 100, remote computer 316, or mobile device 318. The player may specify how token values are to be used if they are about to expire. For example, the player may specify that token management server 302 is to automatically wager on a progressive entry or lottery entry for the token value associated with a token that is about to expire. As another example, the player may specify that token management server 302 is to convert a monetary token value into a non-monetary prize, such as a coupon for entertainment or a hotel discount.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A gaming machine configured to communicate with at least one server via a network, said gaming machine comprising:

a housing;

a display device supported by the housing and configured to display a game to a player playing on said gaming machine;

an input device supported by the housing;

an acceptor supported by the housing; and a controller configured to operate with said display device, said input device, and said acceptor to:

establish a credit balance based at least in part on a monetary value associated with a physical item following receipt of the physical item by the acceptor;

place a wager on a play of the game following receipt of an actuation of a wager input, the credit balance decreasable by the wager;

detect an award trigger during the play of the game at a first point in time and award a token upon detection of the award trigger, wherein the token includes an activation date, an expiration date, and a value that is unknown to the player at the time of being awarded;

at a second point in time on or near the activation date, the second point in time being subsequent to the first point in time, notify the player that the token is active;

at a third point in time subsequent to the second point in time, receive a redemption request from the player to redeem the token;

determine, in response to receiving the redemption request from the player, a redemption status of the token;

based on the redemption status, either: (a) reveal a value of the token and provide the value of the token to the player between the activation date and the expiration date, or (b) notify the player that the token is expired; and initiate a payout associated with the credit balance following receipt of a cashout input.

2. The gaming machine of claim 1, wherein the token has no redeemable value until the activation date.

3. The gaming machine of claim 1, wherein said controller is configured to determine the redemption status by comparing a current date to the activation date.

4. The gaming machine of claim 3, wherein said controller is configured to determine the redemption status by comparing the current date to the expiration date.

5. The gaming machine of claim 1, further comprising a player tracking interface configured to:

receive a player identifier; and retrieve player account information corresponding to the player identifier from the at least one server.

6. The gaming machine of claim 5, wherein said display device is further configured to display a player account interface configured to display the player account information.

7. The gaming machine of claim 6, wherein said controller is further configured to receive from the at least one server and to display via said player account interface a number of tokens awarded to the player, a number of active tokens that may be redeemed, and a number of expired tokens.

8. The gaming machine of claim 7, wherein the at least one server reallocates the values of any expired tokens to at least one other player, and wherein said player account interface is configured to display the values of any expired tokens.

9. The gaming machine of claim 6, wherein said player account interface is configured to receive a token trade transaction input from the player, and wherein said controller is further configured to initiate the trade transaction with at least one other player via the at least one server.

10. The gaming machine of claim 6, wherein said player account interface is configured to receive a token sale transaction input from the player, and wherein said controller is further configured to initiate the sale transaction with at least one other player via the at least one server.

11. The gaming machine of claim 6, wherein said player account interface is configured to receive a token purchase transaction input from the player, and wherein said controller is further configured to initiate the purchase transaction with at least one other player via the at least one server.

12. The gaming machine of claim 6, wherein said player account interface is configured to receive a redemption extension request input from the player.

13. A gaming system comprising:

a plurality of gaming machines that each comprise a housing, a display device supported by the housing and configured to display a game and player account information to a player of said gaming machine, an input device supported by the housing, an acceptor supported by the housing, and a controller configured to operate with the display device, the input device, and the acceptor to: (1) establish a credit balance based at least in part on a monetary value associated with a physical item following receipt of the physical item by the acceptor; (2) place a wager on a play of the game following receipt of an actuation of a wager input, the credit balance decreasable by the wager; (3) display the play of the game; and (4) initiate a payout associated with the credit balance following receipt of a cashout input; and at least one server configured to communicate with said plurality of gaming machines via a network, said at least one server configured to:

detect an award trigger during the play of the game at one of said plurality of gaming machines at a first point in time and award a token to the player of said gaming machine upon detection of the award trigger, wherein the token includes an activation date, an expiration date, and a value that is unknown to the player of said gaming machine at the time of being awarded;

at a second point in time at or near the activation date, the second point in time being subsequent to the first point in time, notify the player of said gaming machine that the token is active;

at a third point in time subsequent to the second point in time, receive a redemption request from the player of said gaming machine;

determine a redemption status of the token;

in response to a determination that the redemption status is active, reveal a value of the token to the player of said gaming machine; and in response to a determination that the redemption status is expired, notify the player of said gaming machine that the token is expired.

14. The gaming system of claim 13, wherein said display device of said gaming machine is further configured to:

display a player tracking interface;

receive a player identifier via said player tracking interface; and receive the player account information from said at least one server.

15. The gaming system of claim 13, wherein said at least one server is further configured to transmit an activation message to the player of said gaming machine.

16. The gaming system of claim 15, wherein the activation message includes a redemption time period that is a time period beginning on the activation date and ending on the expiration date.

17. The gaming system of claim 13, wherein said at least one server is further configured to transmit a warning message to the player of said gaming machine at a preselected time before the expiration date.

18. The gaming system of claim 13, wherein the token has no redeemable value until the activation date.

19. The gaming system of claim 13, further comprising a remote player device remotely coupled to said at least one server via the network, said remote player device configured to display the player account information to the player of said gaming machine.

20. The gaming system of claim 13, wherein said at least one server is configured to determine the redemption status by comparing a current date to the activation date.

21. The gaming system of claim 20, wherein said at least one server is configured to determine the redemption status by comparing the current date to the expiration date.

22. The gaming system of claim 13, wherein the player account information includes a number of tokens awarded to the player of said gaming machine, a number of active tokens that may be redeemed, and a number of expired tokens.

23. The gaming system of claim 22, wherein said display device is configured to display, via the player account interface, the values of any expired tokens.

24. The gaming system of claim 22, wherein said at least one server is further configured to monitor the redemption status of all awarded tokens and to reallocate the values of any expired tokens to at least one other player.

25. The gaming system of claim 24, wherein said at least one server is configured to reallocate the values of any expired tokens based on a player level of the at least one other player.

26. The gaming system of claim 24, wherein said at least one server is configured to randomly allocate the values of any expired tokens.

27. The gaming system of claim 24, wherein said at least one server is configured to reallocate the values of any expired tokens to players having played the game within a specified time period.

28. The gaming system of claim 13, wherein said at least one server is further configured to initiate a token trade transaction between the player of said gaming machine and at least one other player.

29. The gaming system of claim 13, wherein said at least one server is further configured to initiate a token sale transaction input between the player of said gaming machine and at least one other player.

30. The gaming system of claim 13, wherein said at least one server is further configured to initiate a token purchase transaction input between the player of said gaming machine and at least one other player.

31. The gaming system of claim 13, wherein said at least one server is further configured to extend the expiration date based on a request by the player of said gaming machine.

32. A method of operating a gaming system, said method comprising:

receiving, by an acceptor, a physical item associated with a monetary value;

establishing, by at least one processor, a credit balance based at least in part on the monetary value associated with the received physical item;

receiving, by at least one input device, a wager input;

placing, by the at least one processor, a wager on a play of a game responsive to the wager input;

displaying, by at least one display device, the play of the game;

detecting, by the at least one processor, an award trigger during the play of a game at a first point in time and awarding, by the at least one processor, a token to a player upon detection of the award trigger, wherein the token includes an activation date, an expiration date, and a value that is unknown to the player at the time of being awarded;

at a second point in time at or near the activation date, the second point in time being subsequent to the first point in time, notifying, by the at least one processor, the player that the token is active;

at a third point in time subsequent to the second point in time, receiving, by at least one input device, a redemption request;

determining, by the at least one processor, a redemption status of the token;

in response to a determination that the redemption status is active, revealing, by the at least one display device, a value of the token to the player;

in response to a determination that the redemption status is expired, notifying, by the at least one processor, the player that the token is expired;

receiving a cashout input; and initiating, by the at least one processor, a payout responsive to the cashout input.

33. The method of claim 32, further comprising receiving, by a player tracking interface, a player identifier and transmitting, by at least one server, player account information associated with the player identifier to a gaming machine.

34. The method of claim 32, further comprising transmitting, by the at least one processor, an activation message to the player.

35. The method of claim 34, wherein transmitting, by the at least one processor, the activation message includes transmitting, by the at least one processor, a redemption time period that is a time period beginning on the activation date and ending on expiration date.

36. The method of claim 32, further comprising transmitting, by the at least one processor, a warning message to the player at a preselected time before the expiration date.

37. The method of claim 32, wherein the token has no redeemable value until the activation date.

38. The method of claim 32, further comprising displaying, by a remote player device, the player account information to the player.

39. The method of claim 32, wherein determining, by the at least one processor, the redemption status comprises comparing, by the at least one processor, a current date to the activation date.

40. The method of claim 39, wherein determining, by the at least one processor, the redemption status comprises comparing, by the at least one processor, the current date to the expiration date.

41. The method of claim 33, further comprising displaying, by the at least one display device, the player account information, wherein the player account information includes a number of tokens awarded to the player, a number of active tokens that may be redeemed, and a number of expired tokens.

42. The method of claim 41, wherein displaying, by the at least one display device, the player account information comprises displaying, by a player tracking interface, the values of any expired tokens.

43. The method of claim 41, further comprising monitoring, by the at least one processor, the redemption status of all awarded tokens and reallocating, by the at least one processor, the values of any expired tokens to at least one other player.

44. The method of claim 43, wherein reallocating, by the at least one processor, the values of any expired tokens comprises reallocating, by the at least one processor, the values of any expired tokens based on a player level of the at least one other player.

45. The method of claim 43, wherein reallocating, by the at least one processor, the values of any expired tokens comprises randomly reallocating, by the at least one processor, the values of any expired tokens.

46. The method of claim 43, wherein reallocating, by the at least one processor, the values of any expired tokens comprises reallocating, by the at least one processor, the values of any expired tokens to players having played the game within a specified time period.

47. The method of claim 32, further comprising initiating, by the at least one processor, a token trade transaction between the player and at least one other player.

48. The method of claim 32, further comprising initiating, by the at least one processor, a token sale transaction input between the player and at least one other player.

49. The method of claim 32, further comprising initiating, by the at least one processor, a token purchase transaction input between the player and at least one other player.

50. The method of claim 32, further comprising extending, by the at least one processor, the expiration date based on a request by the player.

51. A non-transitory computer readable medium that stores a plurality of computer-executable components, the computer-executable components comprising:

a credit balance component that when executed by at least one processor causes the at least one processor to establish a credit balance based at least in part on a monetary value of a physical item following receipt of the physical item by an acceptor;

a game component that when executed by the at least one processor causes the at least one processor to place a wager on and display a game to a player via a gaming machine following receipt of a wager input, the credit balance decreasable by the wager;

a detection component that when executed by the at least one processor causes the at least one processor to detect an award trigger during play of the game on the gaming machine at a first point in time;

an award component that when executed by the at least one processor causes the at least one processor to award a token to the player upon detection of the trigger at the first point in time, wherein the token includes an activation date, an expiration date, and a value that is unknown to the player at the time of being awarded;

a notification component that when executed by the at least one processor causes the at least one processor to, at a second point in time on or near the activation date, the second time being subsequent to the first point in time, notify the player that the token is active;

an award redemption component that when executed by the at least one processor causes the at least one processor to:

at a third point in time subsequent to the second point in time, receive a redemption request from the player;

determine a redemption status of the token; and in response to a determination that the redemption status is active, reveal a value of the token to the player; and in response to a determination that the redemption status is expired, notify the player that the token is expired; and a cashout component that when executed by the at least one processor causes the at least one processor to initiate a payout following receipt of a cashout input.

52. The non-transitory computer-readable medium of claim 51, wherein the token has no redeemable value until the activation date.

53. The non-transitory computer-readable medium of claim 51, wherein the award redemption component, when executed by the at least one processor, causes the at least one processor to determine the redemption status by comparing a current date to the activation date.

54. The non-transitory computer-readable medium of claim 53, wherein the award redemption component, when executed by the at least one processor, causes the at least one processor to determine the redemption status by comparing the current date to the expiration date.

55. The non-transitory computer-readable medium of claim 51, further comprising a player account interface component that, when executed by the at least one processor, causes the at least one processor to cause at least one display device to display player account information to the player, wherein the player account information includes a number of tokens awarded to the player, a number of active tokens that may be redeemed, and a number of expired tokens.

56. The one or more non-transitory computer-readable medium of claim 51, wherein the award redemption component, when executed by the at least one processor, causes the at least one processor to monitor the redemption status of all awarded tokens and reallocate the values of any expired tokens to at least one other player.

* * * * *